United States Patent [19]

Sandström

[11] Patent Number: 4,647,247

[45] Date of Patent: Mar. 3, 1987

[54] METHOD OF COMPACTING A MATERIAL LAYER AND A COMPACTING MACHINE FOR CARRYING OUT THE METHOD

[75] Inventor: Åke Sandström, Sollentuna, Sweden

[73] Assignee: Geodynamik H. Thurner AB, Stockholm, Sweden

[21] Appl. No.: 639,260

[22] Filed: Aug. 9, 1984

Related U.S. Application Data

[63] Continuation of Ser. No. 406,223, Aug. 2, 1982, abandoned.

[30] Foreign Application Priority Data

Dec. 3, 1980 [SE] Sweden ..... 8008495-7

[51] Int. Cl.[4] ..... E01C 19/28

[52] U.S. Cl. ..... 404/75; 404/103; 404/117; 404/130; 74/61; 172/40

[58] Field of Search ..... 404/72, 75, 103, 117, 404/130, 133; 172/40; 74/87, 61

[56] References Cited

U.S. PATENT DOCUMENTS

| | | | |
|---|---|---|---|
| 2,766,629 | 10/1956 | Booth | 74/61 |
| 3,385,119 | 5/1968 | Berger | 74/61 |
| 3,398,798 | 8/1968 | Shelton | 172/1 |
| 3,415,174 | 12/1968 | Kaltenegger | 404/117 |
| 3,435,741 | 4/1969 | Mozdzanowski | 404/117 |
| 3,465,599 | 9/1969 | Hennecke et al. | 74/61 |
| 3,543,656 | 12/1970 | Roettger | 404/117 |
| 3,844,671 | 10/1974 | Domenighetti | 404/117 |
| 3,871,788 | 3/1975 | Barsby | 404/117 |
| 3,892,496 | 7/1975 | Martinez | 404/117 |
| 4,187,036 | 2/1980 | Haker et al. | 404/117 |
| 4,285,405 | 8/1981 | Weir, Jr. | 74/61 X |

FOREIGN PATENT DOCUMENTS

| | | | |
|---|---|---|---|
| 1212004 | 3/1966 | Fed. Rep. of Germany . | |
| 1758996 | 4/1971 | Fed. Rep. of Germany . | |
| 2656347 | 6/1978 | Fed. Rep. of Germany . | |
| 116681 | 11/1958 | France . | |
| 384019 | 1/1965 | Switzerland . | |
| 394823 | 6/1972 | Switzerland . | |
| 1148006 | 4/1969 | United Kingdom . | |
| 683811 | 9/1979 | U.S.S.R. | 74/87 |

OTHER PUBLICATIONS

"The Influence of Repeated Shear Reversal on the Compaction of Granular Material", P. Ansell and S. F. Brown, Geotechnical Testing Journal.

"A Cyclic Simple Shear Apparatus for Dry Granular Material", P. Ansell and S. F. Brown, Geotechnical Testing Journal, ASTM, vol. 1, No. 2, 1977, pp. 82–92.

*Primary Examiner*—Stephen J. Novosad
*Assistant Examiner*—John F. Letchford
*Attorney, Agent, or Firm*—Nils H. Ljungman

[57] ABSTRACT

Method and apparatus for compacting a layer of material using a compacting machine having at least one drum which is rolled over the layer; the material layer is acted on by gravitational force of the roller and an oscillating force. The latter is the result of applying a rapidly substantially alternating torque to the drum about its axis. The direction of action of the torque is reversed with a high frequency in relation to the frequency with which the direction of travel of the compacting unit is reversed. The invention also embraces means for executing the method wherein the torque on the drum is provided by at least two synchronously operating, rotating eccentric means spaced from the shaft of the drum, and which are adapted such that the forces caused by their synchronous movement can substantially neutralize each other radially to the drum and co-act to form a pure torque on the drum about its shaft.

10 Claims, 19 Drawing Figures

DIFFERENTIAL GEAR FOR COMMON DRIVE OF FIG. 1

METHOD OF COMPACTING A MATERIAL LAYER AND A COMPACTING MACHINE FOR CARRYING OUT THE METHOD

This is a continuation of application Ser. No. 06/406,223, filed on Aug. 2, 1982, now abandoned.

The present invention relates to a method of compacting or densifying a material layer and a compacting machine for carrying out the method. A method and means are particularly characterized in that at least one drum acts on the material layer with a gravitational force and an oscillating force.

In conventional vibratory rollers or compactors, the vibration is obtained by means of a rotating eccentric means e.g. inside a drum or roller, the drum being given a substantially circular or elliptical path. In the prior art there is also apparatus with several coacting eccentric means for obtaining improved performance and decreased bearing stresses.

Other contributions to the art have been made, for example, by the Swiss Pat. No. 384019, which teaches arranging two eccentric means having opposing directions of rotation, so that the forces caused by the rotation will balance each other in the horizontal direction but supplement each other vertically. The purpose is to provide a directed effect with substantially vertical compacting force from the drum and substantially vertical drum movement.

The French Pat. No. 1166681 relates to a vibrating roller with at least two vibrators attached to the cylindrical surface of a drum. Each vibrator contains an eccentric mass which rotates in the same direction by means of power transmission from a central drive shaft in the drum. Harmonic frequencies are generated in the vibrating movement of the drum by means of slipping or gliding in the power transmission.

Trials have shown that the number of alternations in the shear stress direction in a layer of material which is compacted has great importance for the degree of compaction achieved in the layer.

A conventional vibratory roller usually generates large, varying, vertical, downward force. This vertical force, per se, gives rise to shear stresses in the material layer, which vary in magnitude with the frequency at which the eccentric means operates (referred to hereinafter as the "eccentric frequency"). However, the shear stresses do not change direction with the eccentric frequency, since no appreciable tensile stress can occur at the contact surface between roller and ground. A change in shear stresses direction occurs due to the static load, but only once per roller pass, when the roller slowly moves over the material layer.

In the article "A cyclic simple shear apparatus for dry granular material" in "Geotechnical Testing Journal", ASTM, Vol. 1, No. 2, 1978, Ansell and Brown have described simple laboratory equipment for testing purposes, where a static load is applied and where rapid alternation in direction of the shear stresses in a material is achieved. Trials made with the equipment show that a better compaction effect is obtained than by conventional techniques.

The U.S. Pat. No. 3,543,656 relates to a vibratory roller with two drums, each supported in a yoke connected to a frame via vibration - damping material. An eccentric mass is arranged in each yoke for rotating about a horizontal axis above the respective drum. This results in that a yoke, the drum mounted therein and the rotating eccentric mass are caused to move about a horizontal axis situated between the axis of the drum and that of the eccentric mass, which gives the lower portion of the drum a movement including a reciprocating component along the material layer.

An object of the present invention is to provide shear stresses during compacting a material layer, such that the stresses repeatedly and rapidly change direction in the material layer as the roller passes over the material.

A second object of the invention is to provide a compacting machine with a drum where the stresses from the drum on its mounting and on the rest of the machine will be comparatively small.

A third object of the invention is to provide a compacting machine where the movements in the material layer which is compacted will be substantially limited to a comparatively small volume in the material layer close to the machine.

A fourth object of the invention is to enable the construction of a compacting machine which consumes comparatively little energy in order to achieve a prescribed degree of compaction in a material layer.

The invention is based on the idea of compacting or densifying a layer of material with the aid of a drum rolling on the material layer, said drum chiefly subjecting the material layer to downward gravitational forces of substantially constant magnitude and simultaneously alternating forces of rapidly varying magnitude in the tangential direction of the drum. These alternating forces of rapidly varying magnitude are according to the invention achieved by applying a substantially pure rapidly alternating torque to the drum about its shaft. Due to reaction forces from the material layer on the drum and when the drum is slowly moved or propelled conventionally along the material layer, the total absolute movements of the drum will be more complicated than a pure alternating turning motion about the drum axis. What is important to the invention and to the compaction, however is that a substantially pure alternating torque is applied to the drum about its axis, and that this torque causes rapidly alternating forces on the surface of the material substantially parallel to the surface irrespective of the rolling of the drum provided that the alternating frequency and torque magnitude are high enough in relation to the speed of rolling.

The novel, and particularly distinguishing features of the invention, and the advantages thereof, as well as a more practical implementation of a compaction method and a compacting machine in accordance with the invention will now be described with reference to the appended drawings, where FIG. 1 illustrates the compaction principle according to the abovementioned article by Ansell and Brown.

Figure 4:
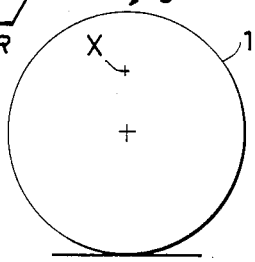
Fig. 4 PRIOR ART
Figure 5:
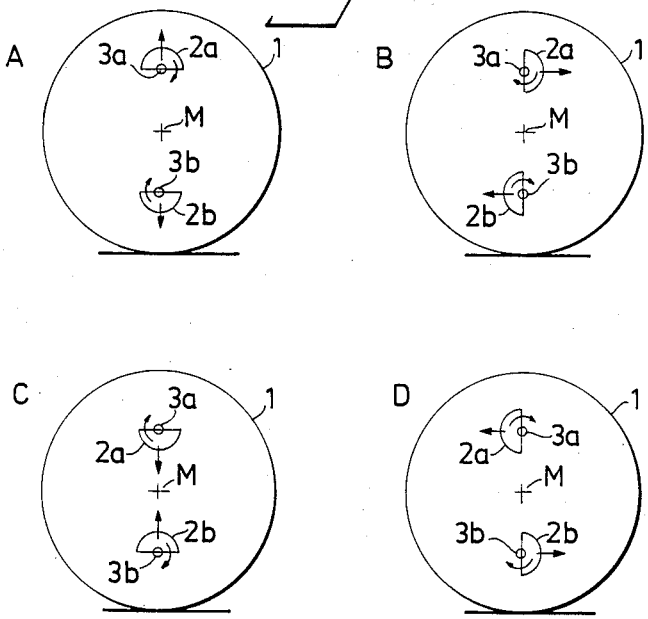

FIG. 4 attempts to illustrate in a somewhat simplified form compaction according to the above-mentioned U.S. Pat. No. 3,543,656.

FIGS. 5A–D illustrate the basic idea behind the present invention and the application of a substantially pure alternating torque to a drum about its axis.

Figure 6:
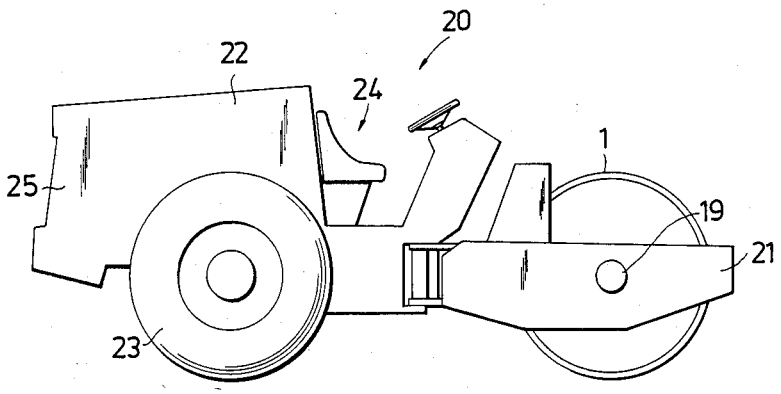

FIG. 6 illustrates, heavily simplified, a self propelled compacting machine with propulsion on the rear wheels and forwardly provided with a compacting drum in accordance with the invention.

Figure 7:
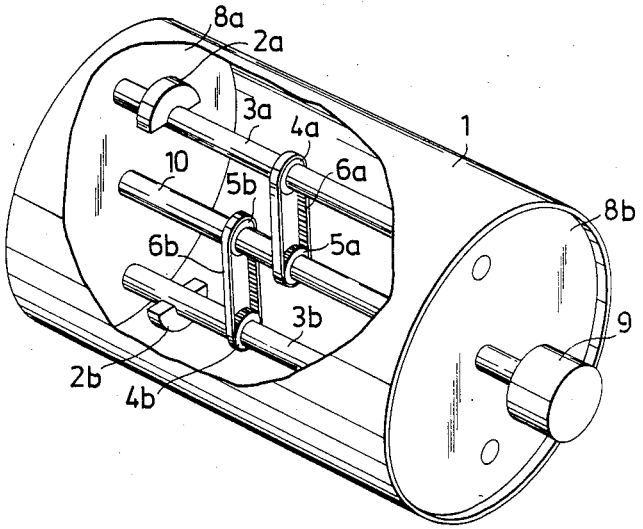

FIG. 7 illustrates, heavily simplified, an arrangement for applying a substantially pure alternating torque to a drum about its axis.

Figure 8:
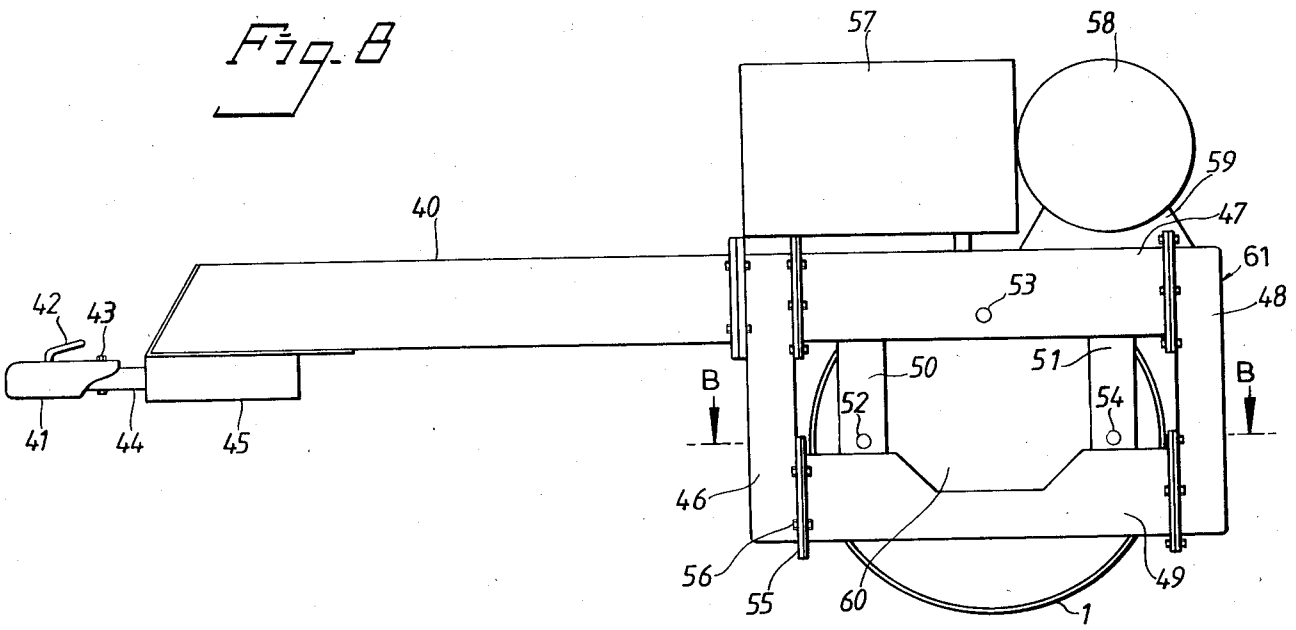

FIG. 8 is a side view of a compacting machine in accordance with the invention, intended for towing by a vehicle.

Figure 9:
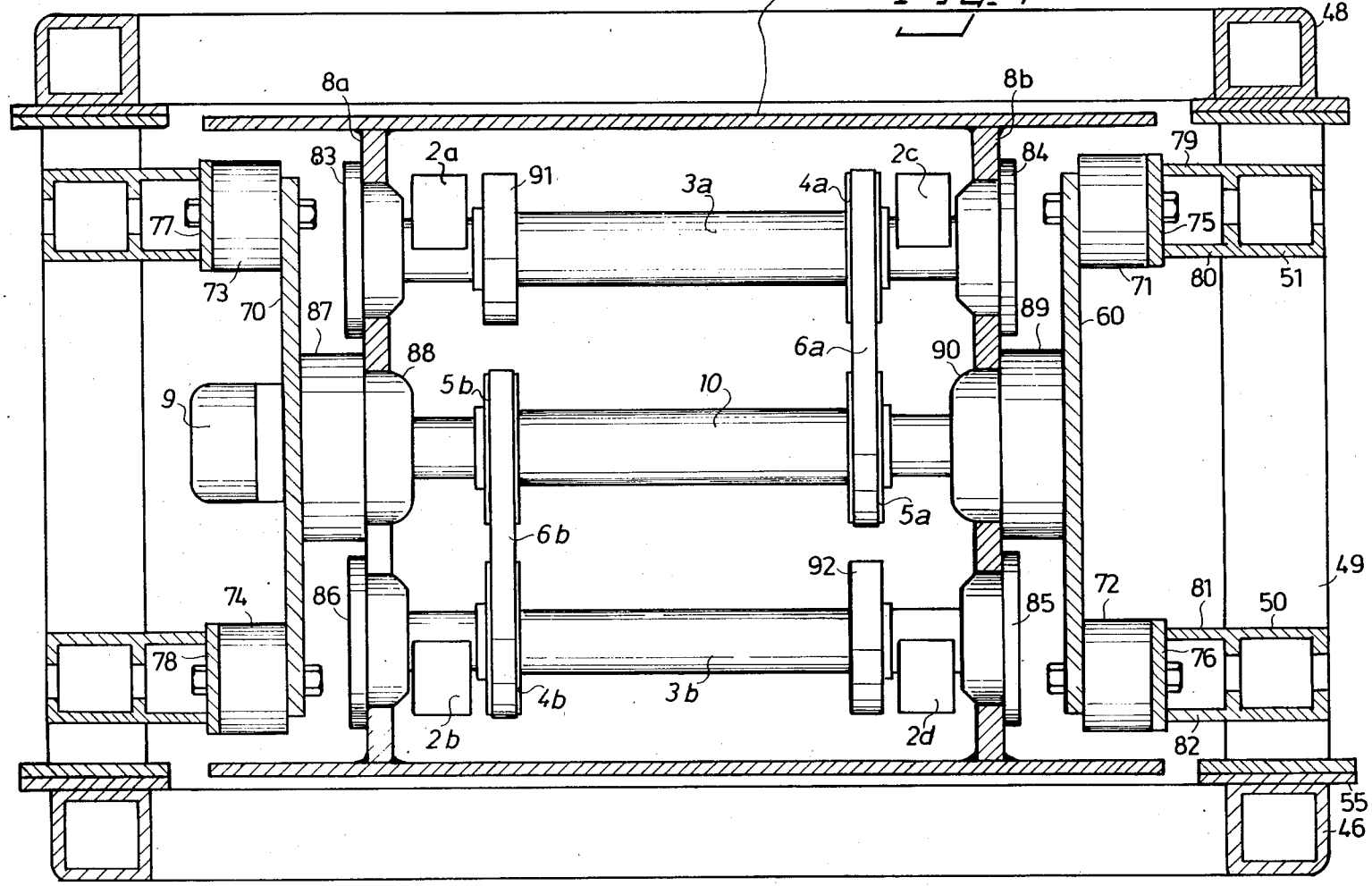

FIG. 9 is a partial section through an embodiment of a compactor in accordance with the invention.

Figure 10A:
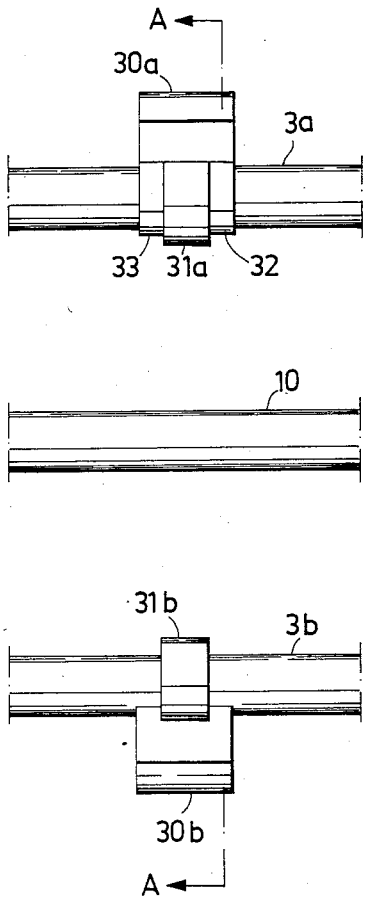
Figure 10B:
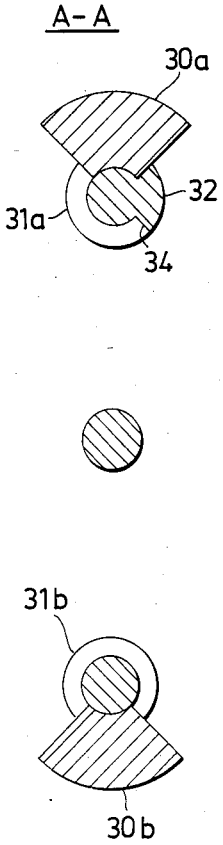

FIGS. 10A–B are heavily simplified illustrations of how a compacting machine in accordance with the invention can be formed so that it can be optionally set for conventional compaction or compaction in a accordance with the invention.

Figure 11:
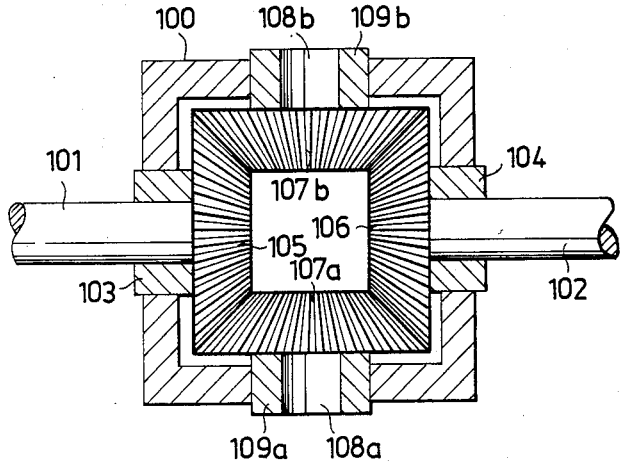
Figure 12:
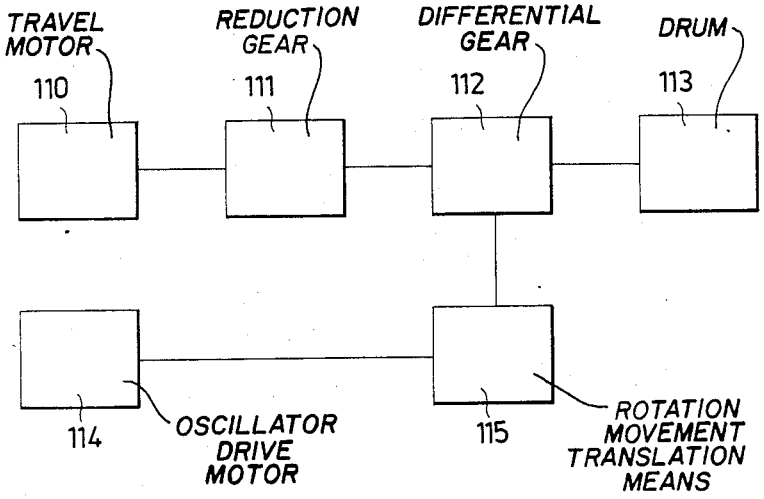

FIGS. 11 and 12 illustrates an alternative embodiment of the invention.

FIGS. 13–18 are graphs illustrating measured results and quantities in compaction tests with an embodiment of the compacting machine in accordance with the invention.

Figure 1:
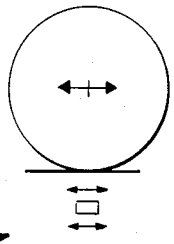
Fig. 1 PRIOR ART

In conjunction with the previously mentioned laboratory experiments, Ansell and Brown have proposed a principle for compaction according to FIG. 1, in which the whole drum is caused to vibrate horizontally for providing rapidly alternating shear stress. No further information is offered on how the horizontal vibration is to be provided in practice.

There are many ways of generating the drum motion desired in compacting a material layer conventionally or in accordance with the invention. In describing the basic principles and ideas behind compacting machines according to the above-mentioned article and the patent specifications, as well as in accordance with the invention, it is assumed for the sake of simplicity that the drum movement in FIGS. 2–5 is provided with the aid of rotating eccentric masses.

Figure 2:
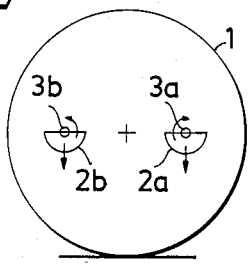
Fig. 2 PRIOR ART
FIG. 2 illustrates the principle of providing directed effect with substantially vertical compaction force and motion of the drum, with the aid of two eccentric means having opposing directions of rotating, e.g. according to the above-mentioned Swiss Pat. No. 384019.

As illustrated in FIG. 2, vertically directed force and drum movement, e.g. according to the Swiss Pat. No. 384019, is provided with the aid of two eccentric masses *2a, 2b,* each attached to, and rotating with a shaft *3a, 3b,* in the drum 1. The shafts *3a, 3b,* are mounted so that they only accompany the translation movements of the drum but not the turning movements thereof about its center.

The masses are the same and the shafts are at equal spacing from the axis of the drum. With their respective shafts *3a* and *3b* the eccentric masses *2a* and *2b* respectively, rotate synchronously at the same rate but in opposite directions. Accordingly, *2a* and *3a* rotate clockwise, while *2b* and *3b* rotate anticlockwise synchronously and with the same rpm as *2a* and *3a*.

This rotation causes the masses and drum to exercise forces on each other via the shafts. This interplay of forces is illustrated in the figure by vectors from the centres of the respective masses directed outwardly from the centers of the respective shafts. The direction of the forces varies synchronously with the angular position of the masses during rotation. The mutual orientation of the masses *2a* and *2b* during their synchronous rotation at the same rpm, i.e. their phase position relative each other, is intentionally selected so that the forces on the drum coact vertically but counteract each other horizontally. On rotation, the eccentrically mounted masses do not affect the drum with any resulting oscillating torque about the drum axis.

Figure 3:
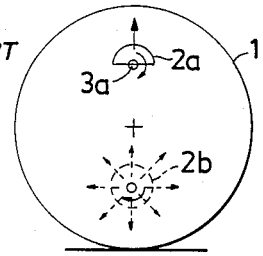
Fig. 3 PRIOR ART
FIG. 3 is an attempt to illustrate compaction with two eccentric means in a compactor drum according to the above-mentioned French Pat. No. 1166681.

FIG. 3 is an attempt to illustrate the principle of generating motion for a compacting drum according to the French Pat. No. 1166681. The drum motion is provided by one or more pairs of vibrators attached to the inside cylindrical surface of the drum. The two vibrators in a pair are on opposing sides of a drive shaft in the centre of the drum, and are axially displaced in relative each other on either side of the drum center. Each vibrator contains a mass eccentrically attached to and rotating with a shaft. The shafts are caused to rotate by power transmission from the drive shaft at the centre of the drum.

It is not entirely clear from the French Patent whether the eccentrically attached masses in a pair of vibrators are equally as great. Neither is it apparant whether power and movement transmission from the drive shaft to the shafts of the eccentric means is formed such that the shafts get identical, or nearly the same rpm.

On the other hand, it is stated in the French patent specification that phase displacement takes place between the eccentrics means due to gliding or slipping in the transmission. This phase displacement is said to give raise to a vibration frequency of the drum which is different from the frequencies of the vibrators. FIG. 3 illustrates a mass attached to a shaft *3a* rotating clockwise. A force vector from the centre of the mass is directed away from the shaft *3a*. A second-mass suspended on a shaft *3b* and rotating asynchronously with the mass *2a* is illustrated by the dashed circle *2b*. A force vector rotating synchronously with the mass *2b* is illustrated by a plurality of dashed arrows.

Although it is not clearly stated in the French patent, both vibrators in a pair exert a complicated combination of translation forces and torques on the drum, due to said slip and phase shift, as well as the different locations of the eccentric means along the axial extension of the drive shaft. The torques act about the central drive shaft as well as about an axis through the centre of the drum and at right angles to the axes of the eccentric means. Thus according to the French patent, no substantially pure alternating torque is applied to the drum about it axis.

The U.S. Pat. No. 3,543,656 describes a soil compacting machine with two drums, each being vibrated with the aid of its own eccentric means arranged above the respective drum. The respective drum and eccentric means is rotatably mounted in a yoke which is in turn resiliently suspended in the frame sections. The respective eccentric means provides a vibratory motion, not only of the drum but also of itself and the yoke. As depicted in FIG. 4, the motion, which is a combination of translation and turning motion takes place relative to a point x between the shaft 3 and the central axis, of the drum. If the compacting machine were freely suspended in the air, the respective eccentric means would not provide any torque to the respective drum about its central axis, but when the machine compacts a layer of material, forces from the layer will cause a alternating turning motion when the eccentric means displaces the drum relative the point x. Thus according to said U.S. patent no substantially pure alternating torque is applied to the drums about their axes by the eccentric means.

The generation of compacting motion in a drum for a compacting machine in accordance with the invention is different in principle from what has been described above in respect of the prior art.

Since a substantially pure alternating torque is applied in the present invention to the drum about its axis, oscillating forces to the material tangential to the circumference of the drum may be provided, without any translation forces directly caused by the eccentric means affecting the drum shaft. The advantages of such an arrangement are obvious, especially regarding the insulation of the drum motion from the chassis of the compacting machine, which in conventional vibratory rollers constitutes a problem which is difficult to solve. It will be most clearly seen from FIGS. 5A–D how the alternating torque in accordance with the invention can be generated, these Figures illustrating the principle of the invention using two eccentric masses 2*a*, 2*b* rotating synchronously and in the same direction, and also illustrating the masses in four different angular positions. It is clearly apparent from the Figures that the torque M on the axis of the drum 1, caused by the eccentric masses 2*a* and 2*b* is zero in FIGS. 5A and 5C, while it has its greatest value in one direction in FIG. 5B and this value in the other direction in FIG. 5D. It is also apparent that the eccentric masses together do not produce any significant translation force at the drum axis in any position.

Although one skilled in the art naturally understands this, it is pointed out that there is no significance for the torque if the shafts 3*a* and 3*b* are in a plane through the drum centre which is vertical, horizontal or along any other diagonal. What is essential is that the force vectors rotate synchronously and with the same rpm and direction of rotation as illustrated in FIGS. 5A–5D.

A compacting machine 20 is illustrated in FIG. 6, and provided with a drum 1 having eccentric means in accordance with the invention. The compacting machine 20 is conventionally constructed with two sections 21 and 22, the forward section 21 constructed as a frame carrying the drum 1 and articulated with the rear section 22 for steering. The rear section 22 carries the driving seat 24 and possibly a cabin for the driver, as well as the power unit 25 for propelling the compactor via rubbertired wheels 23 and for providing power to the hydraulic motor 19 driving the eccentric means. The drum 1 can further be conventionally provided with a hydraulic motor (not shown) for propulsion. The described compactor illustrated in FIG. 6 is only to be regarded as an example of the application of the invention, and not as a detailed description of how the compacting machine is constructed in general.

FIG. 7 illustrates how an apparatus in accordance with the invention, as principly illustrated in FIGS. 5A–D, may be constructed. It comprises a conventional drum 1 accommodating two pairs of eccentric masses 2*a* and 2*b*, arranged for rotation in the same direction and at the same velocity. The pairs of eccentric masses 2*a* and 2*b* are rigidly attached to shafts 3*a* and 3*b* mounted in the end walls 8*a* and 8*b* of the drum 1, at given equal spacing from the central axis of the drum, so that the axes of the shafts 3 are in the same plane as said axis. A drive shaft 10 for the axes 3*a* and 3*b* is mounted in the center of the drum. The drive shaft 10 is provided with a motor 9, placed outside one end wall. In turn, the motor 9 is resiliently suspended in the frame 21 via conventionally arranged bearing, housing and resilient means (not shown in the figure). Suitable power transmisssion from the drive shaft to the shafts 3*a* and 3*b* is also arranged, in FIG. 7 taking the form of chain or toothed belt transmission 4*a*, 5*a*, 6*a* and 4*b*, 5*b* and 6*b*. It is also possible to use gear wheels. On the other hand, transmission members permitting slip, such as vee belts or the like may not be used since it is essential that the phase relationship between the pairs of eccentric masses is kept unchanged at 180°. Minor deviations from this phase displacement in the practical embodiment does not notably affect the intended function however.

Apart from the eccentric masses 2*a* and 2*b* shown near one end wall 8*a* of the drum, the shafts 3*a* and 3*b* carry similar eccentric masses near the other end wall 8*b* of the drum. Several eccentric masses may be placed on the respective shaft in a manner known per se, or as an alternative each shaft can carry a uniformly distributed eccentric mass along the whole or a major portion of its available length.

The shape of the eccentric masses 2*a* and 2*b* given to them in FIG. 7 only constitutes an example for the purpose of illustrating the inventive concept. Every other form of eccentric mass involving a displacement of the centre of gravity from the shaft, and which can withstand the stresses occuring in the application can be utilized within the scope of the invention. A condition is, of course, that the eccentric masses are formed to provide a substantially pure oscillating torque on the drum about its axis.

In the described apparatus, the eccentric masses provide a sinusoidally varying torque resultant on the drum about its axis, which gives rise to oscillating shear stress variations in the material layer to be compacted by the drum. When the drum bears against a substructure which is to be compacted or consolidated, the forces at the contact surface between drum and substructure will constitute in addition to an oscillating horizontal force a vertical force arising from the weight of the compacting machine.

Slower shear stress alternations would be possible per se, and depend on the rate at which the compactor is passed over the substructure, by repeatedly moving the compacting machine backwards and forwards over the substructure. Due to the weight of the compacting machine, material compaction carried out thus will be demanding in energy, and the frequency at which the travel of the compactor can be reversed will be low compared with the frequency with which the eccentric means in a compacting machine in accordance with the invention can cause the drum to give shear stress variations.

The invention can also be realized with more than two eccentric means in the drum. If these eccentric means are commonly alike excepting the angular positions of their masses and have their shafts arranged parallel to the rotational axis of the drum, their axes may be uniformly distributed along a circle concentric with the drum axis. The eccentric means will rotate synchronously in the same direction, and the phase difference between the eccentric masses on adjacent shafts will be equal to the angle between planes through the respective shaft axes and the drum axis, so that all the forces from the eccentric masses are directed radially outwards from the drum axis at instances corresponding to FIG. 5A.

The invention has many applications, e.g. in machines with several drum, one or more of which is provided with eccentric means in accordance with the invention, or in machines intended for propelling with the aid of a towing vehicle. FIG. 8 illustrates such a trailer, seen from one side. This trailing compacting machine, weighing, for example, about 900 kg, is built up with a frame or chassis 61 fabricated from hollow sections and also formed with a towing bar carrier 40. A drum 1 is suspended from the chassis, which carries a tank 57 and pump 58 for hydraulic fluid. A pulling force transducer 45 is arranged on the underside of the forward end of the carrier 40. The pulliung force transducer is joined to a towing bar 44 at the free end of which a conventional towing coupling 41 with releasing handle 42 is attached by means of a bolted joint 43, for connecting the compactor to the towing ball of a vehicle. The carrier 40 is fabricated from two rectangular hollow sections, welded together at the end carrying the transducer 45 and diverging backwards in an acute angle to each other. The rear ends of the carrier have welded flanges connected to the chassis 61 by means of bolted joints. The chassis 61 includes a forward frame section 46 and a partially similar rear frame section 48. These frame sections comprise hollow rectangular sections welded to form a rectangular frame with welded-on flanges 55 at mutually opposing corners for connection by means of bolted joints 56 to longitudinal weldments. The forward frame section 46 differs from the rear one 48 only in that at a distance from each forward corner it has a flange welded on for connection to the carrier 40. The two frame sections 46 and 48 are united by the two weldments extending in the longitudinal direction of the machine, each of the former being fabricated from an upper hollow section 47 and a lower hollow section 49, which are provided with welded-on flanges at either end and are mutually connected by means of vertical hollow section stiffeners 50 and 51. Between said stiffeners, the lower beam formed by the hollow section 49 is provided with a shallow portion by means of a depression in its upper edge line.

On the upper side of the chassis 61 there is a base structure 59 for mounting a pump 58, which is of the radial piston type for hydraulic fluid compressed by a motor (not shown) supplied from a tank 57, thus forming a hydraulic unit of conventional type. As will be seen in detail from FIG. 9, which is a partial section along the line B—B in FIG. 8, the drum of the compactor is suspended in the chassis 61 by a suspension plate 60, 70 on either side. The suspension plate 60 is attached by bolted joints to three rubber shock absorbers, there being a forward shock absorber 72 and a rear shock absorber 71 mounted on either side of the centre axis of the drum 1, and an upper rubber shock absorber (not shown) mounted vertically above the centre axis of the drum 1. The three rubber shock absorbers are of conventional type, and are cylindrical, with the availability of screw connection of both end surfaces to form a resilient connection therebetween. The end surfaces of the shock absorbers facing away from the suspension plates 70 are screwed to one longitudinal frame of the chassis 61 by the forward shock absorber 72 being screwed to a fastening plate 76 forming a weldment with spacers 81 and 82 on the stiffener 50, the rear shock absorber 71 being screwed to an attachment plate 75 forming a weldment with spacers 79 and 80 on the stiffener 51. In a corresponding manner, (not illustrated,) the upper shock absorber is attached to the upper beam 47. To facilitate fitting the shock absorbers, holes 52, 53 and 54 (see FIG. 8) have been made in both stiffeners 50, 51 and the upper beam 47.

The suspension plate 70 on the other side of the drum 1 is resiliently suspended in the same manner via the forward shock absorber 73 on the attachment plate 77, the rear shock absorber 74 on the attachment plate 78 and via an upper shock absorber (not shown) attached to its associated upper beam. The drum diameter may be 60 cm and its is 85 cm. The weight of the drum with contents is, for example, 310 kg.

The contents of the drum 1 conform in principle with what is disclosed in conjunction with FIG. 7, where applicable. Accordingly, a central drive shaft 10 is direct-driven by a driving motor 9 screwed on to the suspension plate 70 for the purpose of driving the eccentric means. The driving motor 9 is hydraulic and is connected conventionally to the pump 58 with hoses (not shown). The drive shaft 10 is conventionally mounted in bearing housings 88 and 90 screwed into the respective end wall 8*a*, 8*b*. The housing 88 and 90 are furthermore rotatably mounted in bearing housing 87 and 89, which are screwed onto the suspension plates 70 and 60 respectively, thus allowing rotation of the drive shaft 10 independent of the rotation of drum 1. The drive shaft 10 rotation is transferred synchronously to the shafts 3*a* and 3*b*, carrying the eccentric masses, by means of toothed belts 6*a* and 6*b* and four like toothed wheels 5*a*, 4*a* and 5*b*, 4*b*. The shafts 3*a* and 3*b* are mounted in the drum end walls 8*a* and 8*b* on either side of the drive shaft 10 by means of the bearing housings 83, 86 and 84, 85 screwed onto the drum end walls 8*a* and 8*b*, respectively. The housings 83, 84, 85, 86 are of standard type containing roller bearings, which are also utilized in the bearing housings 87, 88, 89, 90. For the sake of symmetry, the shafts 3*a* and 3*b* are each provided with a toothed wheel 91, 92 the same as the toothed transmission wheels 4*a*, 4*b* the wheels 91, 92 being mounted symmetrically on the respective shaft at the same distance from the centre of the drum as the respective toothed transmission wheel. The shaft 3*a* is provided with one eccentric mass 2*a* screwed onto the shaft 3*a* close to the bearing housing 83, and a like eccentric mass 2*c* in register with the mass 2*a* and screwed to the shaft close to the other bearing housing 84. In a corresponding mode, the other shaft 3*b* is provided with two like eccentric masses 2*b* and 2*d*, driving of the shafts 3*a* and 3*b* being arranged such that both eccentric masses on one shaft always have the same rate of revolutions and are displaced 180°, i.e. with a phase shift of 180°, in relation to the eccentric masses on the other shaft.

It is advantageous if the compacting machine can be formed so that it can be directed between two or more alternative modes of operation, e.g. with the oscillation mode according to the invention and with conventional vibration mode with force substantially vertical to the substructure. This can be arranged comparatively simply with the eccentric means arrangement described by changing the phase angle between the eccentric masses on one of two shafts from 180° to 0°.

An example of such a change in practice would be by having the eccentric masses on at least one of the shafts carrying them made rotatable between two end positions in relation to said shaft. The end positions in each direction are selected such that when the shafts rotate in one direction the relative phase angle is 180° and when they rotate in the other direction the relative phase angle is 0°. A corresponding result can also be achieved with more than two shafts and their associated eccentric masses, but then the phase angles between the different eccentric masses, in the case of operation in accordance with the inventive concept, must depend on the geometric relationship of their shafts to each other, so that the resulting translation force in the radial direction of the drum is always zero.

In the case of translation force, i.e. conventional operation, the phase angles between all the eccentric means nust be zero, so that they coact to give an effect corresponding to a centrically placed shaft with its eccentric masses and with an eccentric moment equal to the sum of the eccentric moments of the masses.

In FIGS. 10*a–b* there is illustrated a portion of the drive shaft 10 and shafts 3*a* and 3*b* with their eccentric masses, the embodiment being such that driving the shafts is arranged to take place synchronously as in FIG. 7. FIG. 10*a* is a partial view from one side while FIG. 10*b* is a section along the A—A in FIG. 10*a*. The main portion of the eccentric masses 30*a* and 30*b* in this case occupy 90° of a circular ring about the respective shaft 3*a* or 3*b*. The eccentric mass 30*a* is mounted rotatably about the shaft 3*a* with the aid of the smaller annular portion 31*a*, surrounding the remainder of the shaft 3*a*. At the side of the annular portion 31*a* there are stops 32 and 33 adapted rigidly attached to the shaft 3*a*. Each stop constitutes a portion of a ring taking up 90° of the circumference of the shaft, and its location is such that it allows 180° angular movement of the eccentric mass 30*a* about its shaft when the rotational direction of the shafts is reversed. The other eccentric mass 33 is mounted on the shaft 3*b* with the aid of the annular portion 31*b*, substantially corresponding to the portion 31*a*, but is rigidly attached to the shaft 3*b*. In the position of the eccentric masses 30*a* and 30*b* illustrated in FIG. 10, it is assumed that driving of the shafts thereof is anticlockwise, thus obtaining oscillating turning motion on the drum. When the direction is reversed so that both shafts 3*a* and 3*b* are driven clockwise the shaft 3*a* turns 180° in relation to the eccentric mass 30*a*, while the eccentric mass 30*b* remains fixed on the shaft 3*b*, the eccentric masses 30*a* and 30*b* rotating in phase with each other to obtain conventional vibratory operation of the drum.

For providing and applying the substantially pure oscillating torque in accordance with the invention on the drum of an inventive compacting machine, it is not absolutely necessary to have shafts with eccentric masses arranged inside the drum according to FIGS. 7 or 9. There are of course other methods and means for generating the pure alternating torque on the drum about its axis. FIGS. 11 and 12 illustrate an alternative particularly developed for such compacting machines where propulsion for the travel of the machine backwards and forwards over the layer of material is provided by driving the drum. Propulsion of such machines is done by applying a torque to the drum about its axis. This torque which is intended for moving the machine by rolling the drum, changes direction when the direction of travel of the machine over the material layer is reversed. Since reversing the machine movement backwards and forwards over the material layer cannot take place particularly rapidly due to the vehicle speed during compaction and weight of the compacting machine, it will be appreciated that the torque intended for propelling the machine changes direction very slowly compared with the alternating frequency of the torque in accordance with the invention.

Somewhat simplified, FIG. 11 illustrates a conventional differential gear used for superposing a rapidly reciprocating torque on a constant or slowly varying torque. The differential gear has a housing 100 in which an input shaft 101 and an output shaft 102 are journalled in bearings 103 and 104, respectively. A first gear 105 is attached to the input shaft and a similar gear 106 is attached to the output shaft. Two further gears 107*a*, and 107*b* are identical with gears 105 and 106 and in mesh therewith in the housing. The gears 107*a* and 107*b* are provided with journals 108*a* and 108*b* for mounting in bearings 109*a* and 109*b* in the housing. If the input shaft is rotated in a given direction, e.g. clockwise, while the housing is prevented from turning, then the output shaft rotates just as much in the opposite direction, in this case anticlockwise. On the other hand, if the housing is turned in the same or the opposite direction in relation to that of the input shaft, the output shaft is turned more or less, respectively, than when the housing is kept stationary.

FIG. 12 is a block diagram of an arrangement facilitating a method of driving a drum 113, and simultaneously giving it a substantially pure oscillating torque, a differential gear 112 according to FIG. 11 being used. For travel of the whole compacting machine backwards and forwards over the material layer there is a travel motor 110, driving the input shaft of the differential gear 112 via a reduction gear 111. The output shaft of the differential gear is connected to the drum for conventionally providing its turning movement about its centre.

A rotating movement translation means 115 is connected to the housing of the differential gear to provide a reciprocating torque to the housing about the input and output shafts. The movement translation means, which can conventionally convert a continuous input turning movement to a reciprocating turning motion or torque is driven by an oscillator motor 114. The rpm of the oscillator drive motor 114 is high compared with the rpm of the differential gear input shaft.

The arrangement according to the block diagram in FIG. 12 provides a torque for total movement of the drum which comprises a comparatively slow rotational movement and a superposed comparatively rapidly by alternating torque. The arrangement thus provides approximately the same movements at the centre of the drum and its circumference, respectively, as are provided by the embodiments in FIGS. 6–9 when the drum is rolling on the material layer.

If it is desirable or preferred, it is naturally conceivable to allow the motor 110 also to drive the rotating movement translation means 115 instead of the motor 114. In the arrangement according to FIG. 12, there is suitably included resilient means between the different parts of the compacting machine, but these as well as mounting the parts of the arrangement on the machine have been excluded for the sake of simplicity.

Compaction trials have been carried out with a compacting machine embodiment according to FIGS. 8–9. For reference in compaction, the same embodiment has been used, but the arrangement of the eccentric masses and shafts and their driving has been altered so that in FIG. 9 the shaft 3*a* has been turned half a revolution in relation to shaft 3*b*. The relative phase positions of the eccentric masses thus became such that the drum obtained a conventional vibratory movement. To obtain different amplitude and frequency of the oscillating torque on the drum about its centre in accordance with the invention, experiments have been made with different sized eccentric mases and different frequencies in the range 25–70 Hz.

The compaction trials have been carried out on a substructure comprising about 2 m natural base gravel with a grain size of 0–32 mm which was well compacted with a vibrating plate compactor in 40 cm layers. Over this was placed 80 cm crushed base gravel with a grain size of 0–32 mm which was well compacted. The uppermost layer of 25 cm was loosened within an area of 1.5 m width and 5 m length. The upper surface was smoothed off, after which the surface was compacted with 16 passes of the compacting machine embodiment. The latter was towed backwards and forwards and in the same path the whole time. The speed of travel was constant at about 0.8 m/s.

Two different trial series will be compared in the following, one with an oscillating mode in accordance with the invention and one with conventional vibratory mode of operation of the drum. For the latter case, a trial series have been selected with typical parameters for a conventional vibrating compacting machine with a similar drum as the one on the inventive embodiment, namely a frequency of 50 Hz and a collected eccentric moment of 0.12 kgm, corresponding to a nominal vibration amplitude of about 0.4 mm.

Preparatory trials with the embodiment arranged for oscillating mode of operation showed that a comparable compaction result could be expected with a greater eccentric moment and lower frequency. As a case comparative with the oscillating mode there was thus selected a trial series with a collected eccentric moment of 0.24 kgm, corresponding to a nominal tangential amplitude at the drum cylindrical surface of about 0.8 mm. In this trial series, the oscillating frequency was 40 Hz.

Compaction results achieved in the trials have been estimated using conventional methods such as levelling, plate bearing tests, isotope measurement and also with the aid of a transducer buried in the material layer being compacted, this transducer being affected by movements in the material layer. Furthermore, the power consumption of the hydraulic motor has been measured and the horizontal and vertical acceleration of the drum shaft, as well as other quantities, have been sensed. Some interesting results and conclusions with reference to compaction in accordance with the invention are described in the following with reference to FIGS. 13–18.

Figure 13:
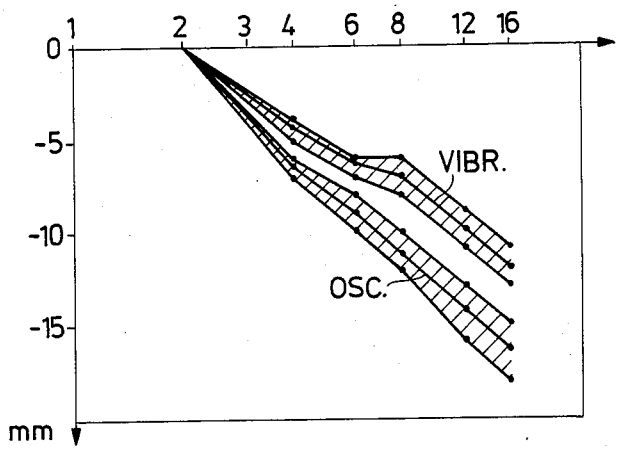

Determination of the level of the compacted surface has been carried out by levelling in three sections at a spacing of one meter. A straight steel beam with a cross section of 50×50 mm and a length of 0.5 m was placed on the compacted surface in the middle of the respective section and at right angles to the direction of travel of the compacting machine. In the middle of the steel beam and on its upper side there was a spherical surface on which a millimeter-graduated levelling staff was placed. Level readings was taken after every second pass, the first time after two passes. The levels relative the level after two passes are shown in FIG. 13. On the abscissa there is given the number of passes in a logarithmic scale and on the ordinate the amount of settle in millimeters. In the diagrams there is given the mean value for the three measuring sections as well as the spread. The lower curve shows the results for the case of the oscillating mode of operation in accordance with the invention and the upper curve for a conventional vibratory mode of operation. These curves show the total amount of settle, including the integrated effect of compaction of the loosened 0.25 m thick upper layer, possible compaction of the layers lying beneath and the effect of possible lateral displacement of material. As will be seen from the results, the oscillating mode of operation gave a significantly greater total amount of settle.

Figure 14:
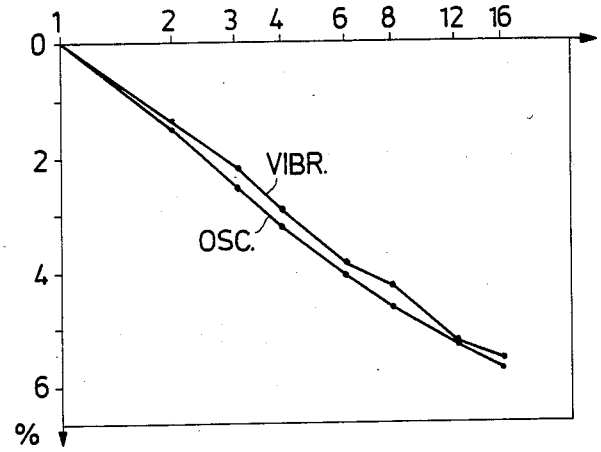

Apart from the total amount of settle at the surface, the deformation in the earth layer was measured with the aid of a device called a deformation meter. The deformation meter comprises two parallel horizontal cylindrical bodies with rounded-off ends united by a vertical thin flexible rod. The rod is connected to a length measuring device built into the lower cylindrical body. An alteration of the distance between both cylindrical bodies can be detected electrically to an accuracy of 0.01 mm. The centres distance between the cylindrical bodies was 75 mm in these trials. The deformation meter was placed in an extended condition in the loosened surface layer with its centre at a depth of about 0.2 m. The results from such a deformation meter, which was placed in an equivalent way in both the trial series is shown in FIG. 14. On the abscissa there is given the number of passes on a logarithmic scale and on the ordinate the percentage deformation based on the measuring length of the meter, i.e. 75 mm. The meter was zeroed after the first pass. The results thus relate to percentage mean deformation in a layer 75 mm thick, the centre of which was at a depth of 0.2 m under the ground surface. The result indicates somewhat higher deformation for the series with the oscillating mode of operation, but the difference is not significant, taking into account the expected spread in measurements of this type in natural soil material. After terminated compaction in each trial series, a plate loading test was carried out using a stiff disk, 300 mm in diameter. The plate loading test was carried out in six cycles with loading and unloading twice each to 10 kN, 20 kN and 50 kN. Moduli of elasticity were calculated for the first and the second loading respectively according to $$E_1 \text{ or } E_2 = 0.75.D.(\Delta\sigma/\Delta s)$$

where

D=disc diameter $\Delta\sigma$=stress increase as an average value over the disc surface for the loading case in question $\Delta s$=amount of settle for stress increase in question.

Figure 15:
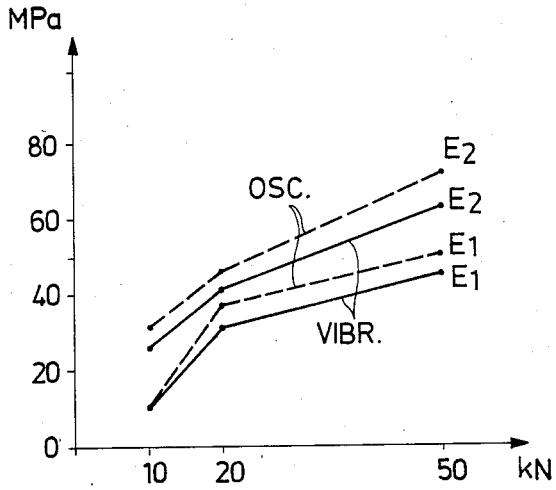

The results from the plate loading tests from both trial series are shown in FIG. 15. Calculated moduli have been set off on the ordinate against the maximum loading as abscissa. The modulus at the first loading ($E_1$) as well as the modulus at the second loading ($E_2$) are shown. The moduli of elasticity obtained are all somewhat lower after compacting with an oscillating drum in accordance with the invention.

Measurements were also carried out by indirect measurement of the compacted soil layer density with the aid of an isotope meter manufactured by DECCA, type HDM-5. As a mean value for two measuring points the isotope meter gave a volumetric density of 2,250 kg/m$^3$ after compacting with the oscillating drum and 2,240 kg/m$^3$ after compacting with a conventional vibratory drum.

The different measuring methods gave no unambiguous result concerning the compaction results achieved. The levelling results indicate considerably higher compaction effect for oscillating mode of operation whereas the plate loading tests show somewhat higher compaction effect for vibrating mode of operation, and two other measuring methods show somewhat higher effect for oscillating mode of operation.

Other conditions for the machine and surroundings have been documented for both trial series described above, namely the power requirement for driving the eccentric means, vibrations in the drum suspension plates and in the chassis, as well as vibrations in the ground surface at a distance from the compacting machine.

The power requirement for driving the eccentric masses has been calculated with the aid of measured pressure drop over the motor driving the eccentric masses, and measured rpm. The power thus registered and supplied to the driving motor of the eccentric masses is utilized to some extent for useful compaction work, but is also consumed in the form of internal losses in the hydraulic motor, the bearings of the shafts and in the belt transmissions. At special measurements, without the eccentric masses being fitted, the loss effects have been measured as being about 800 W at 40 Hz and about 1,000 W at 50 Hz.

Figure 16:
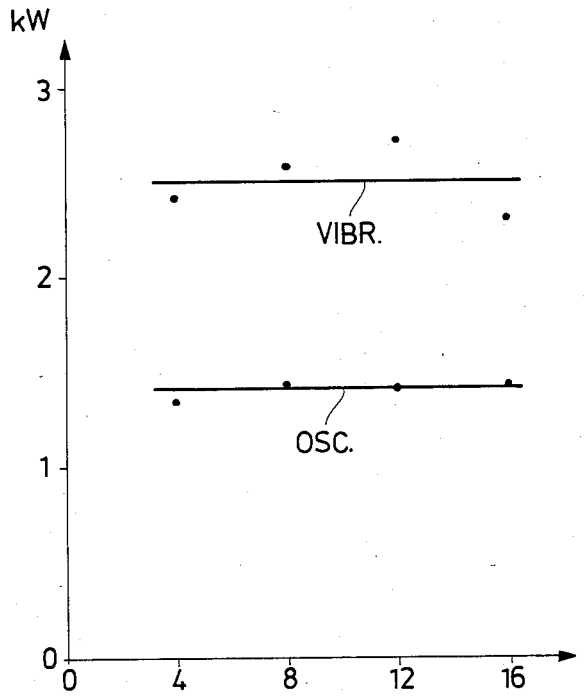

The graph in FIG. 16 illustrates the power supplied to the eccentric drive motor during the two trial series described above. The number of compacting machine passes are given on the abscissa and the total power on the ordinate. The upper graph relates to conventional vibrating compaction and the lower graph to oscillating compaction. The power consumption was fairly constant for the respective series and for the oscillating case it was about 60% of that corresponding to the conventional vibration case. Keeping in mind that the compaction results are comparable this shows that the efficiency is appreciably higher for the oscillating case and to a greater extent than what is apparent from FIG. 16, if consideration is given to the power losses in the respective case.

Figure 17:
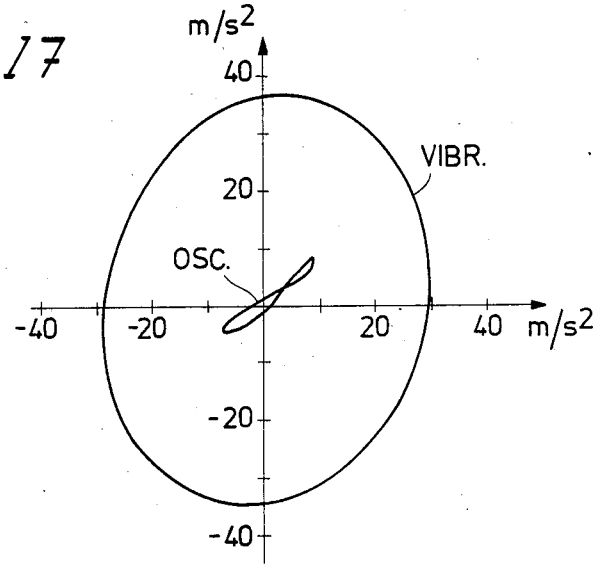

The results obtained from registered accelerations in vertical and horizontal directions on the suspension plates 60 are shown in FIG. 17. Polar curves for the acceleration vector tip movement during one period have been drawn up for the conventional vibration mode of operation as well as for the oscillating mode of operation. As will be seen, the vertical amplitude which is the most important for undesired frame movements, is in the oscillating mode about 20% of the corresponding amount for the conventional mode. The horizontal amplitude for the oscillating mode was about 30% of the corresponding value for the conventional mode.

In the oscillating drum case, it is possible and also suitable to reduce the horizontal acceleration amplitude further by increasing the mass which is not resiliently cushioned, e.g. some section of the chassing being rigidly connected to the suspension plates. This furthermore affords the advantage that the amplitude of tangential motion at the drum circumference along the contact surface with the material layer increases, which increases the compaction effect, providing that the friction between drum and material layer is sufficient to prevent slipping. The corresponding measure can not suitably be utilized for the conventional vibrating compacting machine since this leads to the substantially radial oscillations of the drum being heavily dampened in this case, and if this dampening is compensated by an increase of the eccentric moment, a higher vibration amplitude for the remaining portion of the chassis would occur.

Figure 18:
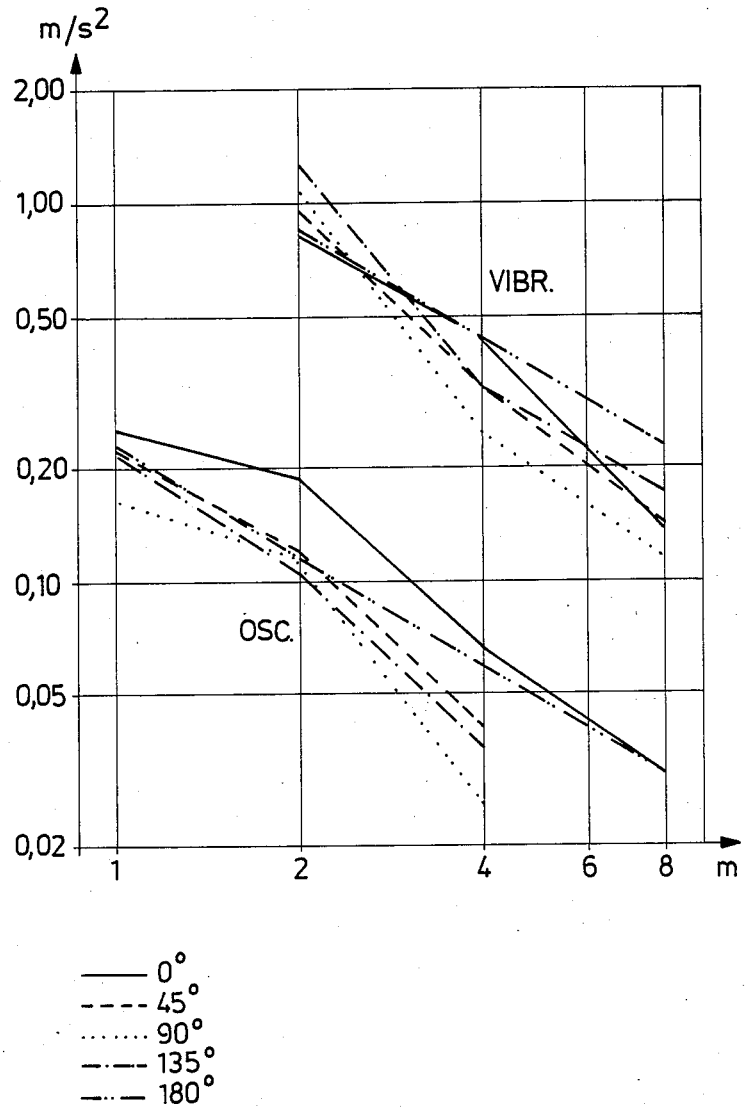

In FIG. 18 there are shown results from a separate investigation of vibration amplitudes at the ground surface at a greater distance from the compactor. The investigation was carried out with a stationary compacting machine on a large, flat, horizontal, asphalted surface. The substructure comprised from below, clay, a layer of gravel of unknown thickness, and asphalt. The measuring points were marked out on the asphalt surface at distances, of 1, 2, 4 and 8 m from the centre of the drum along lines at 0°, 45°, 90°, 135° and 180° to the centre line of the compacting machine path as it travels forwards. A dual axis accelerometer with the measuring directions radially and vertically was placed at the measuring points in turn. The rms value of the accelerations in the respective direction was registered while the eccentric masses were rotating. On the abscissa axis in FIG. 18 the distance has been set out to a logarithmic scale and on the ordinate axis the acceleration amplitude in a logarithmic scale converted to $m/s^2$ top value assuming sinusoidal oscillation with one frequency component. The results indicate the magnitude of the resultant. The five radial directions are shown as separate lines. The same eccentric masses were used as in both the comparative trial series described above. In the case of the oscillating mode of operation the frequency was 40 Hz, as with the comparative series. In the case with a vibrating mode of operation, such a high frequency as 50 Hz could not be used, since the machine was then shifted laterally by the heavy vibrations. The results are therefore given for the frequency of 40 Hz in this case as well. The upper group of curves in FIG. 18 apply to the conventional vibrating drum and the lower group to the oscillating drum. It will be seen from the diagram that the vibration levels are 8 to 10 times lower for the oscillating case, and also that the directional characteristic differs. In the oscillating case the amplitude laterally to the drum (the 90° curve) is considerably lower than forwards (0°) or backwards (180°). The reverse is true in the conventional vibration case at less distances than about 3 m from the machine.

After trials with the compacting machine embodiment it was found that its drum had a very smooth surface. This indicates that the surface had slipped during compaction against the material layer, and had not been capable of transferring the whole of its movement to the material layer. It is therefore conceivable that better compaction results could be obtained with a drum with which there is greater friction to the substructure, e.g. a drum with rubber coating.

In summary it may be said that the trial results show that the object of the invention can be achieved by a compacting machine according to FIGS. 8–9. This embodiment, as well as the embodiments illustrated in FIGS. 6–7 and FIGS. 11–12 are only to be regarded as examples of how the objects of the invention can be realized, and the invention is not restricted to these embodiments.

I claim:

1. A method of compacting a layer of material with a compacting machine, said compacting machine including a drum having a rotational axis for rotation of the drum thereabout, said method comprising the steps of:

motorizedly moving said drum upon said layer of material to be compacted and thereby applying generally downward forces to the layer during movement of the drum upon the layer;

motorizedly changing the direction of movement of the drum, said motorized changes of said direction of movement of said drum having at least a first frequency component;

generating a torque and applying said torque to the drum about said rotational axis thereby generating shear stress components in the layer substantially parallel to the direction of movement of the drum upon the layer of material during the movement of the drum;

repeatedly and rapidly changing the direction of the torque at a second frequency, which is higher than the at least first frequency component, by rapidly and repeatedly reversing the direction of the action of the applied torque to said drum between a substantially clockwise and a substantially counterclockwise direction around the drum axis neutralizing essentially all radial alternating forces applied to the drum with said torque except in said direction of movement; and transmitting the alternating force in said direction of movement of said drum into said layer of material substantially along said direction of movement of said drum, whereby said alternating torque generating alternating shear stress components in said layer of material to be compacted are substantially parallel to said direction of movement of said drum.

2. A method of compacting a layer of material with a compacting machine, said compacting machine including a drum having a rotational axis for rotation of the drum thereabout, said method comprising the steps of:

motorizedly moving said drum upon said layer of material to be compacted and thereby applying generally downward forces to the layer during movement of the drum upon the layer;

motorizedly changing the direction of movement of the drum;

generating a torque and applying said torque to the drum about said rotational axis thereby generating shear deformations in the layer;

repeatedly and rapidly changing the direction of the torque at a frequency between 25 Hz and 70 Hz by rapidly and repeatedly reversing the direction of the action of the applied torque to said drum between a substantially clockwise and a substantially counterclockwise direction around the drum axis neutralizing essentially all radial alternating forces applied to the drum with said torque except in said direction of movement of said drum;

transmitting the alternating force in said direction of movement of said drum into said layer of material substantially along said direction of movement of said drum, whereby said alternating torque generating alternating shear deformations in said layer of material to be compacted are substantially parallel to said direction of movement of said drum.

3. A method of compacting a layer of material with a compacting machine, said compacting machine including a drum having a rotational axis for rotation of the drum thereabout, said method comprising the steps of:

motorizedly moving said drum upon said layer of material to be compacted and thereby applying generally downward forces to the layer during movement of the drum upon the layer;

motorizedly changing the direction of movement of the drum from forwards to backwards and vice versa with a first frequency;

generating an oscillating torque and applying said oscillating torque to the drum about said rotational axis thereby generating an oscillating rotational movement component of the drum causing alternating shear deformations in the layer of material;

repeatedly and rapidly changing the direction of the oscillating torque at a second frequency, which is higher than the first frequency, by rapidly and repeatedly reversing the direction of the action of the applied oscillating torque to said drum between a clockwise and a counterclockwise direction and vice versa around the drum axis whereby the oscillating torque produces alternating shear deformations in said layer of material to be compacted;

neutralizing essentially all radial alternating forces applied to the drum with said oscillating torque, except in said direction of movement; and transmitting the alternating force in said direction of movement of said drum into said layer of material substantially along said direction of movement of said drum, whereby said oscillating torque producing alternating shear deformations in said layer of material to be compacted are substantially parallel to said direction of movement of said drum.

4. A compacting machine using at least one roller drum rotatable about a rotational axis which at least one roller drum can be moved back and forth in a direction with at least one known frequency component in a direction on a surface of a material to be compacted for compacting and densifying said material, said machine being of the type which induces oscillation of said at least one roller drum for aiding machine gravity in material compaction, the compacting machine comprising;

a torque producing means for applying to said at least one roller drum about its rotational axis a substantially pulsating type alternating torque for generating, in use, in said material to be compacted alternating shear components directed substantially parallel to said direction of movement of said at least one roller drum;

means for reversing the torque direction between a clockwise direction and a counterclockwise direction at a second frequency which is higher compared to the known frequency component of back and forth movement of said at least one roller drum; and means for essentially neutralizing a sum of all components of alternating radial forces applicable to at least a portion of said at least one roller drum except in said direction of movement of said at least one roller drum, whereby the alternating force along said direction of movement of said at least one roller drum is transmitted, during use, from said at least one roller drum into said material to be compacted substantially along said direction of movement of said at least one roller drum.

5. A compacting machine using at least one roller drum rotatable about a rotational axis which at least one roller durm can be moved back and forth in a direction on a surface of a material to be compacted for compacting and densifying said material, said machine being of the type which induces oscillation of said at least one roller drum for aiding machine gravity in material compaction, the compacting machine comprising;

a torque producing means for applying to said at least one roller drum about its rotational axis a substantially pulsating type torque for generating, in use, a pulsating turning movement component of the drum, said turning movement of said drum causing in said material to be compacted pulsating shear deformations;

means for reversing the torque direction between a substantially clockwise and a substantially counterclockwise direction around the drum axis at a frequency of 25 to 70 Hz; and means for essentially neutralizing a sum of all components of alternating radial forces applicable to said at least one roller drum with said torque except in said direction of movement of said at least one roller drum, whereby the alternating force along said direction of movement of said at least one roller drum is transmitted, during use, from said at least one roller drum into said material to be compacted substantially along said direction of movement of said at least one roller drum.

6. A compacting machine using at least one roller drum rotatable about a rotational axis which at least one roller drum can be moved back and forth with a first frequency in a direction on a surface of a material to be compacted for compacting and densifying said material, said machine being of the type which induces oscillation of at least one roller drum for aiding gravity forces in material compaction, the compacting, machine comprising;

a torque producing means for applying to said at least one roller drum about its rotational axis an alternating torque for generating an alternating rotational movement component to the drum causing on the surface of said material to be compacted alternating shear deformations;

means for reversing the direction of the torque between a clockwise and a counterclockwise direction and vice versa at a second frequency which is high compared to said first frequency; and means for essentially neutralizing all components of alternating radial forces applied to said at least one roller drum except in said direction of movement, whereby the alternating force along said direction of movement of said at least one roller drum is transmitted, during use, from said at least one roller drum into said material to be compacted substantially along said direction of movement of said at least one roller drum.

7. A compacting machine using at least one roller drum which can be moved back and forth with known frequency for compacting and densifying material on a surface, the machine being of the type which uses centrifugal forces of rotating eccentric weights which, in use, act on the drum to induce oscillating forces on the drum for aiding machine gravity in material compaction, the compacting machine comprising;

a torque means for applying to the drum about its rotational axis a substantially pulsating type alternating torque, said torque producing means including mounting means for neutralizing all components of said centrifugal forces except in one direction; and means for reversing the torque between a clockwise and a counterclockwise direction to generate said substantially pulsating torque around the drum axis with a frequency which is high compared to the known frequency of said back and forth movement of said at least one roller drum, whereby the neutralizing means neutralize all components of said centrifugal forces except an alternating force along a direction of movement of said at least one roller drum, which alternating force is transmitted, during use, from said at least one roller drum into said material to be compacted and densified, substantially along said direction of movement of said at least one roller drum.

8. A compacting machine as claimed in claim 7, wherein the torque producing means includes at least two eccentric means rotating synchronously, said eccentric means being arranged spaced from said drum axis and adapted such that by reason of their synchronous movement the forces on said drum caused by said eccentric means can substantially balance out each other in any radial direction of the drum, and can co-act for the formation of a substantially pure torque on the drum about its axis.

9. A compacting machine as claimed in claim 8 wherein said eccentric means are substantially alike, each eccentric means being adapted for common, synchronous rotation in the same direction about its rotational axis parallel to that of said drum with the rotational axis of said means being disposed at uniform spacing on a circle concentric with said drum axis, and in that any radial forces upon said drum caused by the rotation of said eccentric means are nullified.

10. In a compacting machine using at least one roller drum moving back and forth at a known rotating frequency for compacting and densifying material, the machine being of the type which uses rotating eccentric weight disposed within the roller drum, the drum in use acting on said material with the drum's gravitational force and an induced oscillating force, the improvement comprising:

a torque inducing means comprising rotating eccentric weights for providing to the roller drum about its axis an alternating torque, said torque inducing means including:

as components, at least first and second equal eccentric masses rigidly disposed for rotation respectively on first and second shafts which together with the roller drum axis lie in a substantially common plane during the roller use, said first and second masses being mounted in 180° opposite phase relationship for synchronous rotation while constantly maintaining the 180° opposite phase relationship;

means for driving said first and second shafts in a nonslipping manner in the same rotational direction to maintain said 180° opposite phase relationship of said first and second eccentric masses; and motive means for rotating said first and second shafts at a rotating frequency which is higher than a rotating frequency of said roller drum in use, whereby said torque inducing means generates an alternating force along a direction of movement of said at least one roller drum, and neutralizes other forces generated by said components, so that said alternating force generated along said direction of movement of said at least one roller drum is transmitted, during use, from said at least one roller drum into said material to be compacted and densified substantially along said direction of movement of said at least one roller drum.

* * * * *